United States Patent [19]

Adachi

[11] 4,244,261

[45] Jan. 13, 1981

[54] ELECTRONIC KEYBOARD MUSICAL INSTRUMENT

[75] Inventor: Takeshi Adachi, Hamamatsu, Japan

[73] Assignee: Nippon Gakki Seizo Kabushiki Kaisha, Japan

[21] Appl. No.: 860,879

[22] Filed: Dec. 15, 1977

[30] Foreign Application Priority Data

Dec. 17, 1976 [JP] Japan ..... 51-170193[U]

[51] Int. Cl.[3] ..... G10H 1/02

[52] U.S. Cl. ..... 84/1.24; 84/1.17; 338/69

[58] Field of Search ..... 84/DIG. 7, 1.24, 423, 84/439, 1.17, 1.08; 200/1 B, 5 A, 5 R, 159 B; 338/69, 95, 96

[56] References Cited

U.S. PATENT DOCUMENTS

| | | | |
|---|---|---|---|
| 2,134,323 | 10/1938 | Beach | 200/1 B |
| 3,610,804 | 10/1971 | Matsuura | 84/1.24 |
| 3,965,789 | 6/1976 | Pearlman | 84/1.24 |
| 4,079,651 | 3/1978 | Matsui | 84/1.1 |
| 4,111,092 | 9/1978 | Adachi | 84/1.24 |
| 4,140,039 | 2/1979 | Faulkner | 84/DIG. 7 |

*Primary Examiner*—J. V. Truhe
*Assistant Examiner*—Forester W. Isen
*Attorney, Agent, or Firm*—Ostrolenk, Faber, Gerb & Soffen

[57] ABSTRACT

A manually operated pressure sensitive button assembly is arranged by the side of the keyboard on the top front panel of the instrument, each button being electrically and operationally coupled to an associated element in the main processing system of musical tone signals, in order to control musical tone components such as tone pitch, tone color, tone volume and modulation effect quite concurrently with minimal interruption of the manual operation on the keyboard.

9 Claims, 6 Drawing Figures

ELECTRONIC KEYBOARD MUSICAL INSTRUMENT

BACKGROUND OF THE INVENTION

The present invention relates to an improved electronic keyboard musical instrument, and more particularly relates to an electronic keyboard musical instrument provided with a function to freely and manually control musical tone components of tone source signals generated by the player's operation of the keyboard.

In a conventional musical instrument of the mentioned kind, adjustment of musical tones effected by the player other than by the key specifying operation on the keyboard is in general carried out by such means as expression pedals, knee levers and initial attack on the basis of keyboard touch response. With means such as the expression pedals and the knee levers, however, it is impossible to assure delicate adjustment of musical tones through foot actions applied to the pedals and/or levers. Likewise, the keyboard touch response cannot assure independent adjustment of a plurality of musical tone components, thereby resulting in relatively poor performance.

SUMMARY OF THE INVENTION

The principal object of the present invention is to provide an electronic keyboard musical instrument capable of assuring ideally delicate and free manual adjustment of musical tones produced by key operation.

Another object of the present invention is to provide an electronic keyboard musical instrument enabling independent adjustment of a plurality of musical tone components with minimal interruption of keyboard key operation, thereby affording enriched performance.

In accordance with the present invention, the electronic keyboard musical instrument is provided with a pressure sensitive button assembly arranged by the side of the keyboard on the top front panel of the instrument the buttons of which are electrically and operationally coupled to respective associated elements in the main processing system of musical tone signals and adapted for adjustment of musical tone components such as tone pitch, tone colour, tone volume and modulation effect. Each pressure sensitive button is spring biased so as to allow an elastically deformable and electrically conductive member to spacially face a plurality of fixed contacts spaced from each other in the free state thereof. Junctions of the fixed contacts to a common line are intervened by resistors, respectively. Manual depression of the button overcoming the spring bias causes forced deformation of the deformable member in order to bring it into contact with two or more fixed contacts, thereby establishing a short-circuit between the junctions.

Change in the extent of button depression leads to a corresponding change in a voltage drop across the resistors and, accordingly, change in the voltage of the output signal from the button mechanism.

DESCRIPTION OF THE PREFERRED EMBODIMENTS

Figure 1:
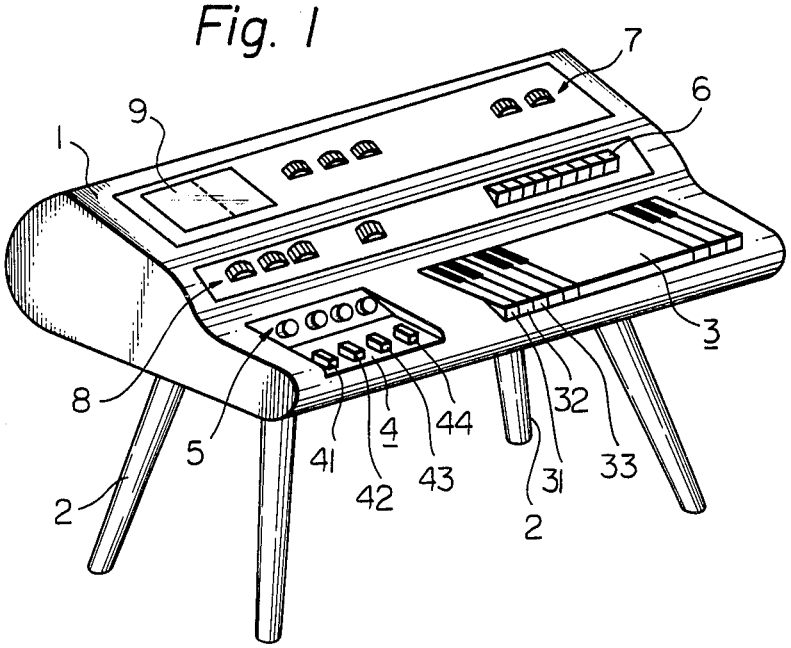
FIG. 1 is a perspective view of an embodiment of the electronic keyboard musical instrument in accordance with the present invention.

One embodiment of the electronic keyboard musical instrument in accordance with the present invention is shown in FIG. 1, in which the main body 1 of the musical instrument is supported in position by four legs 2 standing on the floor and provided with a keyboard 3 arranged on the top front panel thereof. As in the ordinary keyboard musical instruments, the keyboard 3 is made up of a plurality of keys 31, 32, 33 and so on arranged in side-by-side relationship to each other. A pressure sensitive button assembly 4 is arranged by the side of the keyboard 3 and includes out sets of pressure sensitive buttons 41, 42, 43 and 44 arranged in spaced side-by-side relationship to each other. The pressure sensitive button assembly 4 is accompanied by touch sensitivity adjusting volume dials 5 arranged above and behind button assembly 4. A plurality of preset tone colour selection buttons 6 are arranged, on the top middle panel of the main body 1, above and behind the keyboard 3 in side-by-side relationship to each other. In line with these preset tone colour selection buttons 6, a plurality of control dials 8 for total pitch and modulationship to each other. A plurality of manual tone colour setting dials 7 are arranged on the top back panel of the main body 1 in spaced alignment with each other. The top back panel of the main body 1 is further provided with a tone colour memory 9 located behind the control dials 8.

In playing the musical instrument, a player operates the keyboard 3 with the right hand and, concurrently, operates the pressure sensitive button assembly 4 with the left hand in order to freely control a variety of musical tone components.

Figure 2:
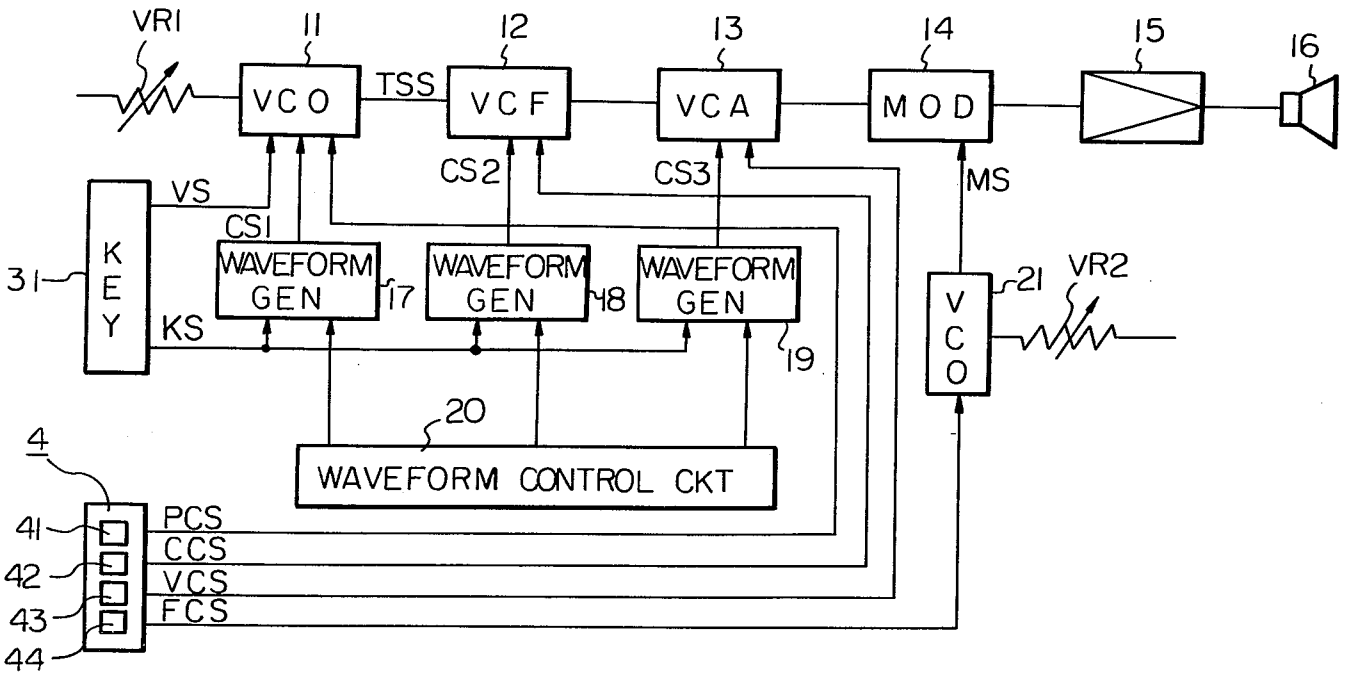
FIG. 2 is a block diagram of an embodiment of the electric system used for the musical instrument whown in FIG. 1.

An embodiment of the electric circuit used for the electronic keyboard musical instrument of FIG. 1 is shown in FIG. 2 in which the principal construction of the circuit is substantially similar to the common electronic musical instruments such as music synthesizers except for provision of the pressure sensitive button assembly 4.

That is, a voltage-control-type variable frequency oscillator 11 is electrically and operationally connected, at the input terminal thereof, to a variable resistor VR1 which is controlled by the total pitch control dial 5 provided on the top middle panel of the main body 1 and, at the output terminal thereof, to a voltage-control-type variable filter 12. The output terminal of the filter 12 is coupled to a voltage-control-type variable gain amplifier 13 which is further connected to a modulator 14 for applying a modulation effect to the tone signal to be processed. If the modulator 14 performs an amplitude modulation, a tremolo is effected and if it performs a frequency modulation or a phase modulation, a vibrato is effected. The modulator 14 may be a so-called ring modulator to effect a kind of tremolo. The output terminal of the modulator 14 is coupled to a speaker 16 via an amplifier 15. The oscillator 11 is accompanied by a control wave form signal generator 17 to output control voltage waveform signals for controling the oscillator 11. Likewise, the filter 12 and the amplifier 13 are accompanied by control wave form signal generators 18 and 19, respectively. The three generators 17, 18 and 19 are connected, at the input terminals thereof, to a waveform control circuit 20 which controls the shapes of the waveforms delivered from the generators 17, 18 and 19. The modulator 14 is accompanied by a voltage-control type low frequency oscillator 21 which provides the modulator 14 with modulation signals. A variable resistor VR2 is connected to the oscillator and is varied by the modulation signal control dial 8 so as to control the center frequency of the oscillator 21.

Each of the keys in the keyboard 3, e.g. the key 31, is coupled, on one hand, to the oscillator 11 in order to provide same with a voltage signal VS corresponding to the tone pitch of each key and, on the other hand, to the three control waveform signal generators 17, 18 and 19 in parallel inorder to provide same with a key-ON signal KS.

As explained already, the pressure sensitive button assembly 4 includes four sets of pressure sensitive buttons 41 through 44. The first button 41 is electrically connected to the oscillator 11, the second button 42 to the filter 12, the third button 43 to the amplifier 13 and the fourth button 44 to the modulation signal generator 21.

The first button 41 is adapted for adjusting tone pitch. Vibrato effect can be adjusted freely by quickly changing the extent of depression on the button at short period. Change in the extent of depression adjusts the vibrato depth and change in the speed of depression adjusts the vibrato speed.

The second button 42 is adapted for adjusting tone colour. It is possible to provide tones with the so-called wah-wah effect.

The third button 43 is adapted for adjusting tone volume. Quick change in the depression at short period enables provision of the tremolo effect also.

The fourth button 44 is adapted for adjusting the oscillation frequencies of the modulation signals, thereby adjusting the modulation effect by the modulator 14.

The operation of the above-described electronic keyboard musical instrument is as hereinafter described.

When the instrument is played without operation on the pressure sensitive button assembly 4, operation on a key, e.g. the key 31, generates the voltage signal VS to be passed to the oscillator 11 and, concurrently, the key signal KS to be passed to the control waveform signal generators 17, 18 and 19. Upon receipt of the key signal KS, the first generator 17 issues a control voltage waveform signal CS1 for controlling the oscillator 11 which accordingly produces a tone source signal TSS. Likewise, the key signal KS passed to the second generator 18 makes the latter produce a control voltage waveform signal CS2 to be input to the filter 12. Then, the filter 12 carries out tone colour formation on the tone source signal TSS from the oscillator 11. The third generator 19 produces a control voltage waveform signal CS3 upon receipt of the key signal KS and the signal CS3 thus produced is input to the amplifier 13 in order to make the latter carry our volume formation on the tone signal from the filter 12. The modulator 14 applies a modulation effect to the tone signal from the amplifier 13 and the tone signal so processed is passed to the speaker 16 via the amplifier 15 for electro-acoustic conversion. Adjustments of the musical tone signal may be carried out by manually operating the elements on the top panel of the main body 1 such as the preset tone colour selection buttons 6, tone colour setting dials 7 and the total pitch and modulation signal control dials 8. This adjustment could be carried out during the performance, but it is intended to be done mainly in advance of the performance. The adjustment according to the invention is intended to be done mainly during the performance and is suited especially for rather transient effects on the musical tones such as vibrato and tremolo.

When the first pressure sensitive button 41 is operated, it issues a tone pitch control signal PCS corresponding to the depth and speed of the depression and the tone pitch control signal PCS is passed to the oscillator 11 in order to adjust the vibrato effect by the latter.

When the second pressure sensitive button 42 is operated, it issues a tone colour control signal CCS corresponding to the depth and speed of the depression and the tone colour control signal CCS is passed to the filter 12 in order to adjust the tone colour formation.

When the third pressure sensitive button 43 is operated, it issues a tone volume control signal VCS corresponding to the depth and speed of the depression and the tone volume control signal VCS is passed to the amplifier 13 in order to adjust the tone volume formation.

When the fourth pressure sensitive button 44 is operated, it issues an oscillation frequency control signal FCS corresponding to the depth of the depression and the oscillation frequency control signal FCS is passed to the modulation signal generator or the oscillator 21 in order to adjust the oscillation frequency of the modulation signal MS to be passed to the modulator 14.

The four set pressure sensitive buttons 41 through 44 may be operated either separately or concurrently by the left hand fingers of the player while the right hand fingers are operating the keyboard 3. When required, an additional, i.e. fifth, pressure sensitive button may be provided for operation by the left hand thumb of the player in order to otherwise adjust the musical tone component or components.

Figure 3A:
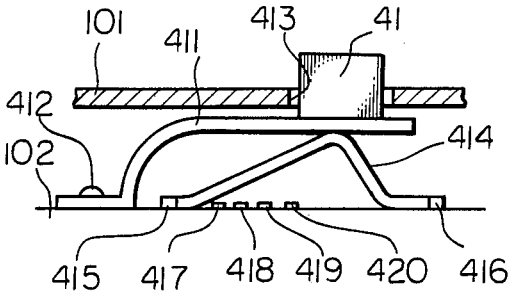
FIG. 3A is a side view, partly in section, of one embodiment of the pressure sensitive button and its related parts when the button is not operated as yet.

One embodiment of each pressure sensitive button, e.g. the button 41, and its related parts is shown in FIG. 3A, in which a top board 101 extends over the base board 102 of the pressure sensitive button assembly 4 and a leaf spring 411 is fixed at one end thereof on the base board 102 by a fastening screw 412 with the other end portion extending spacially along the top board 101. The pressure sensitive button 41 is fixed atop the above-described the other end of the leaf spring 411 and slidably projects over the top face of the top board 101 through an opening 413 formed in the latter. An elastically deformable member 414 is placed under the leaf spring 411 extending in the longitudinal direction of the latter. This deformable member 414 is bent at the top apex thereof with the two lower ends thereof resting on the base board 102, longitudinal displacement of the deformable member 414 being barred by a pair of stoppers 415 and 416 fixed on the base board 102. The top apex of the deformable member 414 is in contact with the bottom surface of the leaf spring 411. The deformable member 414 is made of an electrically conductive material such as electrically conductive rubber. The two sloping legs on both sides of the top apex of the deformable member 414 are different in length from each other.

Figure 4:
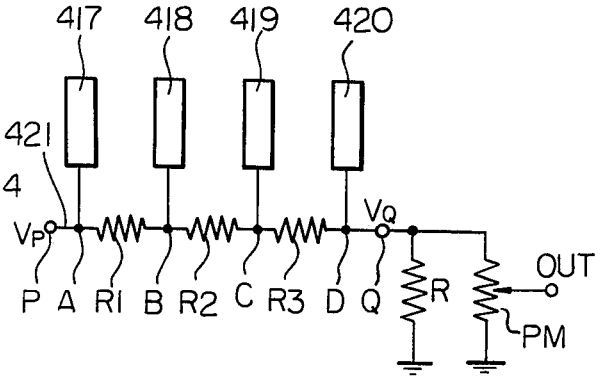
FIG. 4 is a circuit diagram of one embodiment of the electric system accompanying the mechanism shown in FIG. 3A.

Four sets of fixed contacts 417, 418, 419 and 420 are arranged on the base board 102 under the deformable member 414. The four contacts 417 through 420 extend substantially normal to the longitudinal direction of the leaf spring 411 and being substantially equally spaced from each other. As shown in FIG. 4, the four sets of fixed contacts 417 through 420 are connected to a common line 421 and resistors R1, R2 and R3 are inserted into the line 421 at positions thereon between joints of the fixed contacts to the line.

When the pressure sensitive button 41 is not operated, the button 41 is urged to project over the top board 101 due to repulsion of the leaf spring 411 and the deformable member 414 assumes the inactive state shown in FIG. 3A, in which the four fixed contacts 417 through 420 are left untouched by the deformable member 414 or only the first fixed contact 417, i.e. the contact closest to the fixed end of the plate spring 411, is in contact with the deformable member 414. Thus, the total resistance between the two terminals P and Q of the common line 421 is given by R1+R2+R3.

Figure 3B:
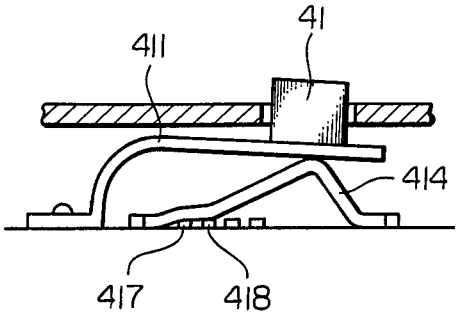
FIG. 3B is a side view, partly in section, of the mechanism shown in FIG. 3A when the button is slightly depressed.

When the button 41 is somewhat depressed overcoming the repulsion by the leaf spring 411, the deformable member 414 is accordingly deformed as same is depressed via the leaf spring 411 and this deformation brings the deformable member 414 into contact with the first and second fixed contacts 417 and 418 as shown in FIG. 3B. Bridging of the two fixed contacts 417 and 418 by the conductive member 414 naturally establishes a short-circuit between the junctions A and B of the contacts 417 and 418 to the common line 421 while excluding the intervening resistor R1. Thus, the total resistance between the two terminals P and Q of the common line 421 is given by R2+R3.

Figure 3C:
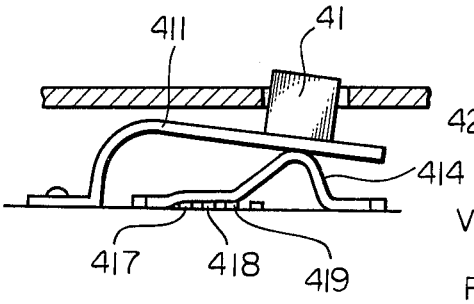
FIG. 3C is a side view, partly in section, of the mechanism shown in FIG. 3A when the button is deeply depressed.

When the button 41 is more depressed overcoming the repulsion by the leaf spring 411, the deformable member 414 is more deformed as same is depressed via the leaf spring 411 and this increased deformation brings the deformable member 414 into contact with the first, second and third fixed contacts 417, 418 and 419 as shown in FIG. 3C. Bridging of the three fixed contacts 417 through 419 by the conductive member 414 naturally establishes a short-circuit between the junctions A and C of the contacts 417 and 419 to the common line 421 while excluding the intervening resistors R1 and R2. Thus, the total resistance between the two terminals P and Q of the common line 421 is given by R3.

When the button 41 is further depressed overcoming the repulsion by the plate spring 411, the deformable member 414 is further deformed as same is depressed via the plate spring 411 and this further increased deformation brings the deformable member 414 into contact with the all fixed contacts 417 through 420. Bridging of these fixed contacts 417 through 420 by the conductive member 414 naturally establishes a short-circuit between the junctions A and D, i.e. the terminals P and Q. Thus, the total resistance between the two terminals P and Q of the common line 421 is null.

Assuming that the voltage at the terminal P is VP and the terminal Q is grounded via a resistor R, the voltage VQ at the terminal Q is dependent upon the voltage drop between the terminals P and Q, i.e. the total resistance between the terminals P and Q which, as already explained, corresponds to the magnitude of the pressure imposed on the button 41. The larger the pressure on the button 41, the smaller the total resistance between the terminals P and Q and the larger the voltage VQ at the terminal Q.

In parallel to the resistor R, a potentiometer PM may be coupled between the terminal Q and ground with its slider tap connected to an output terminal OUT. The slider tap of this potetniometer PM is controlled by the corresponding one of the touch sensitivity adjusting volume dials 5 arranged behind the pressure sensitive button assembly 4 as shown in FIG. 1.

The pressure sensitive button assembly 4 may be manufactured as a unit separate from the main body 1 of the musical instrument and incorporated into the prescribed position on the musical instrument. In addition to the above-described musical tone components, control of other components such as sustain period and portamento can be varried out by utilizing the pressure sensitive button mechanism in accordance with the present invention. The speaker 16 and/or the amplifier 15 may be arranged either inside or outside of the main body 1 of the musical instruments in accordance with sizes of these elements. Further the present invention may be applied to a polyphonic musical instrument.

In accordance with the present invention, the player is able to operate the pressure sensitive button assembly without interrupting busy operation of the keyboard in order to freely control various musical tone components such as tone pitch, tone colour, tone volume and modulation effect, thereby beautifully and ideally enriching the performance.

Although the present invention has been described above in connection with a preferred embodiment thereof, many variations and modifications thereof will now be clear to one skilled in the art, and it is preferred that the scope of the invention be limited not by the details of the specific embodiment described above but only by the appended claims.

What is claimed is:

1. An improved electronic keyboard instrument comprising:

a musical keyboard having a plurality of individually actuatable keys, each of said keys being movable between an on and an off position;

a main processing system for generating a different musical tone in response to the actuation of each respective one of said keys, said main processing system including n musical tone elements, n being an integer greater than 1, each of said musical tone elements controlling a different tonal quality of said musical tones;

a pressure-sensitive member assembly including n manually operable deflectible pressure-sensitive members which are independently operable from each other and independently operable of said keys of said keyboard, each of said pressure-sensitive members sensing the instantaneous pressure applied thereto and controlling the operation of a respective one of said musical tone elements as a direct function of said instantaneous pressure applied thereto independently of the relative pressure applied to those said keys in the on position, independently of the operation of the remaining said pressure-sensitive members and as a function of the pressure applied thereto.

2. An improved electronic keyboard musical instrument as claimed in claim 1 in which said musical tone elements include tone pitch, tone colour, tone volume and modulation effect elements.

3. An improved electronic keyboard musical instrument as claimed in claim 1, wherein said musical tone elements include a variable frequency oscillator, a variable filter for processing signals generated by said oscillator, a variable gain amplifier for processing signals generated by said filter, and a modulator for processing signals generated by said amplifier; and wherein a first one of said pressure-sensitive members is coupled to said variable frequency oscillator, a second one of said pressure-sensitive members is coupled to said variable filter, a third one of said pressure-sensitive members is coupled to said variable gain amplifier and a fourth one of said pressure-sensitive members is coupled to said modulator via a modulation signal generator.

4. An improved electronic keyboard musical instrument as claimed in claim 1, wherein each of said pressure-sensitive members comprises:

a baseboard;

a plurality of resistors coupled in series on said baseboard;

a plurality of electrical contacts disposed on said baseboard, each of said electrical contacts being connected to a junction lying between a different pair of said series coupled resistors;

a manually operable key member; and means for short circuiting different numbers of said resistors by forming a low impedance connection between different numbers of said electrical contacts as a function of the pressure applied to said manually operable key member.

5. An improved electronic keyboard musical instrument as claimed in claim 4, in which said short-circuit means comprises an elastically deformable and electrically conductive member fixedly arranged on said base board and spaced apart from said contacts, and means for elastically biasing said manually operable key member away from said deformable member so that said deformable member is deformed and brought into cntact with at least two of said fixed contacts when said manually operable key member is depressed against the resistance of said biasing means.

6. An improved electronic keyboard musical instrument as claimed in claim 5, in which said biasing means comprises a leaf spring fixed at one end to said base board and having located at its other end said manually operable key member.

7. An improved electronic keyboard musical instrument as claimed in claim 5, in which said deformable member has a pair of legs sloping from an apex generally in the middle of said deformable member towards said base board and different from each other in length.

8. An improved electronic keyboard musical instrument as claimed in claim 5, in which said deformable member is an electrically conductive rubber strip.

9. An improved electronic keyboard musical instrument as claimed in claim 1, further comprising a plurality of sensitivity-adjusting means, each of said sensitivity-adjusting means being operationally connected to a different one of said pressure-sensitive members, whereby the sensitivity of each of said pressure-sensitive members can be adjusted independently of the other said pressure-sensitive members.

* * * * *